United States Patent [19]

Slemmons

[11] 4,420,519

[45] Dec. 13, 1983

[54] NAPKIN RETAINER

[76] Inventor: Charles O. Slemmons, 679 Ardleigh Dr., Akron, Ohio 44303

[21] Appl. No.: 426,938

[22] Filed: Sep. 29, 1982

Related U.S. Application Data

[63] Continuation of Ser. No. 255,305, Apr. 17, 1981, abandoned.

[51] Int. Cl.[3] ..... B32B 7/10; B41L 1/04; G09F 19/00; A45F 5/04

[52] U.S. Cl. ..... 428/40; 428/352; 428/41; 24/7; 24/DIG. 11

[58] Field of Search ..... 428/40, 352

[56] References Cited

U.S. PATENT DOCUMENTS

| | | | |
|---|---|---|---|
| 2,902,734 | 9/1959 | Walters | 428/40 |
| 3,398,438 | 8/1968 | Fried et al. | 24/7 |
| 3,398,439 | 8/1968 | Fried et al. | 24/7 |
| 3,620,891 | 11/1971 | Jones, Sr. | 428/41 |
| 3,675,274 | 7/1972 | Fried et al. | 24/7 |
| 3,978,553 | 9/1976 | Honig | 428/41 |

*Primary Examiner*—George F. Lesmes
*Assistant Examiner*—Nancy A. B. Swisher
*Attorney, Agent, or Firm*—Dale Lischer

[57] ABSTRACT

There is disclosed a napkin retainer which is a composite adhesive tape. The napkin retainer comprises a tape portion with adhesive on both sides and top and bottom protective covers each having a release coating on one side. The tape portion is sandwiched between the protective covers with the release agent in contact with the adhesive. The protective covers each have a hinge strip at one end without release material so that the covers are permanently attached at the hinge strip. Pick tabs are provided on the other end of the protective covers remote from the hinge strip.

2 Claims, 9 Drawing Figures

NAPKIN RETAINER

This is a continuation, of application Ser. No. 255,305, filed Apr. 17, 1981, now abandoned.

This invention relates generally to a composite, adhesive tape and more particularly to a napkin retaining adhesive tape with protective release covers for use in securing a table napkin to the apparel of a diner.

With table napkins, both paper and cloth, there has long existed the annoying problem of having the napkin slide off of the diner's lap. The hapless diner is left to scramble under the table to retrieve the napkin, which may be soiled, or to procure another napkin.

The problem of keeping a table napkin in place is especially acute for airline passengers because of the difficulty of retrieving the napkin within the crowded confines between seats. Moreover, airline passengers often prefer to have the table napkin extend above the lap to protect against spills caused by turbulence. In that regard many airlines have recognized the need to anchor the table napkins above the lap and provide (usually in first class only) cloth table napkins with a button hole to allow the passenger to attach the napkin to his shirt or vest buttons. The button hole napkins are generally of no assistance to women whose apparel may lack the requisite buttons in front. Also providing a button hole is generally impractical for paper napkins, which are more likely to slip and slide than cloth napkins.

Therefore it is an object of the present invention to provide a napkin retainer which allows the diner to secure a table napkin (cloth or paper) to his apparel at any desired location by means of a composite, adhesive tape.

It is further an object of the present invention to provide a napkin retainer which has protective covers for covering the adhesive of the tape before use to protect the adhesive.

It is also an object of the present invention to provide a napkin retainer in which the protective covers are permanently attached to the tape by a hinge means so that they may be removed to expose the tape's adhesive but not come loose from the tape to create litter.

It is also an auxiliary object of the present invention to provide a napkin retainer in which the protective covers can be imprinted with advertising material and the like.

It is further an object of the present invention to provide a napkin retainer's protective covers with a pick tab so that the protective covers can easily be opened prior to use.

Other objects and advantages of the invention will become apparent upon reading the following detailed description and upon reference to the drawings in which.

Figure 1:
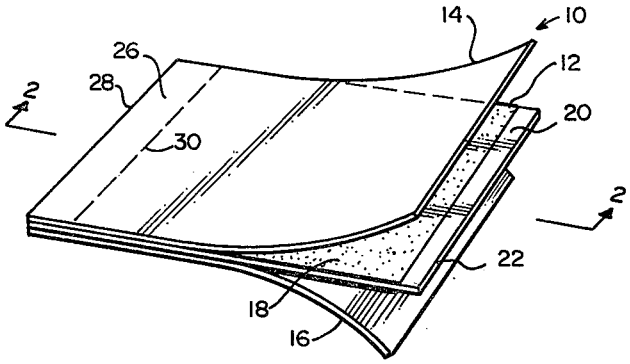
FIG. 1 is a perspective view of one embodiment of the napkin retainer of the present invention.

While the invention is susceptible of various modifications and alternative forms, certain specific embodiments thereof have been shown by way of example in the drawings which will be described in detail herein. It should be understood, however, that it is not intended to limit the invention to the particular forms disclosed, but, on the contrary, the intention is to cover all modifications, equivalents, and alternatives falling within the spirit and scope of the invention.

Figure 2:
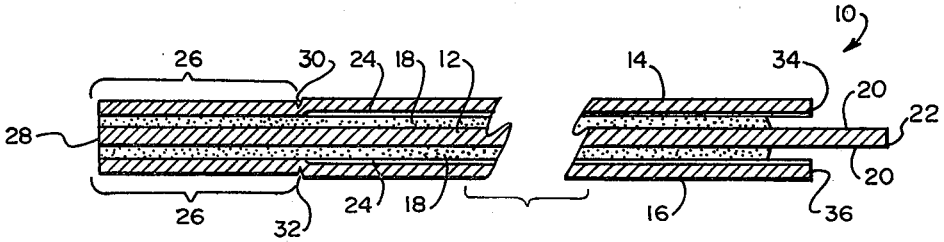
FIG. 2 is a cross-sectional view of the napkin retainer taken along line 2—2 of FIG. 1.
Figure 3:
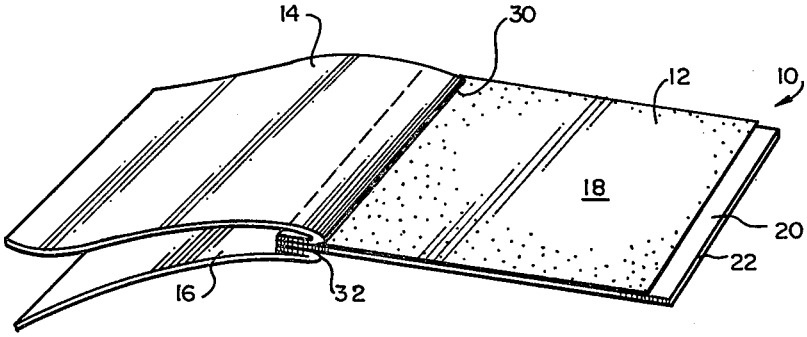
FIG. 3 is a perspective view of the napkin retainer of FIG. 1 showing the napkin retainer open just prior to use.

Turning to FIGS. 1, 2 and 3, there is shown a napkin retainer 10 which is a composite, adhesive tape. The napkin retainer 10 comprises a tape portion 12 with a top protective cover 14 and a bottom protective cover 16 attached to both the top and bottom sides of the tape portion 12.

The tape portion 12 is rectangular in shape with ends 22 and 28 and has an adhesive coating 18 on both sides except for a narrow border on both sides of the tape portion along end 22.

The protective covers 14 and 16 are rectangular and are approximately the same width as the tape portion, but are slightly shorter than the tape portion. Each protective cover, 14 and 16, has an adhesive release agent coating 24 over the majority of one surface. The release agent coating 24 is, however, left off of a hinge anchor border 26 adjacent end 28 of the tape portion. Moreover, both protective covers 14 and 16 are scored (but not severed) laterally along a line 30 and 32 respectively at the inboard edge of border 26 at the boundary of the release agent coating. The other side of the protective covers is uncoated and is suitable for printing advertising and the like.

In the finished napkin retainer 10, the tape portion 12 is sandwiched between protective covers 14 and 16 so that the release agent coating 24 of the covers is in contact with the adhesive 18 of the tape portion. The covers and the tape portion are flush at end 28 resulting in the longer tape portion 12 extending beyond the covers at end 22. It should be noted, as shown in FIG. 2, that the covers are of sufficient length to extend into the border area 20 and cover the adhesive coating 18 to provide loose edges 34 and 36 which serve as pick tabs. The width of the covers is also sufficient to cover the adhesive coating 18.

At end 28 of the tape portion, the hinge anchor border 26 of the covers adheres permanently to the tape portion because of the absence of a release coating on the covers in that area.

In order to use the napkin retainer, the napkin retainer is "opened" by peeling back the protective covers as shown in FIG. 3. Opening the napkin retainer is facilitated by the pick tabs 34 and 36 (FIG. 2) which allow the user to grab easily the covers. The release agent coating 24 on the covers insure that the covers release from the adhesive 18 as they are peeled back. The score lines 30 and 32 act as hinges so that the covers when peeled back will not tend to return to their original position. Moreover, because there is no release coating on the covers at the anchor border 26, the covers stick to the adhesive 18 so that the covers cannot be completely removed from the tape portion to create litter.

Once the covers have been peeled back, the napkin retainer is positioned between the napkin and the diner's clothing at any desired location to hold the napkin in place.

Figure 4:
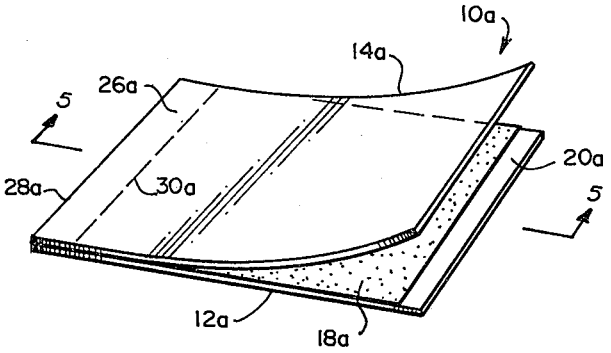
FIG. 4 is a perspective view of a second embodiment of the napkin retainer of the present invention.
Figure 5:
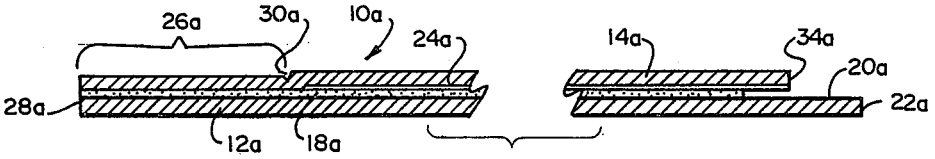
FIG. 5 is a cross-sectional view of the napkin retainer taken along line 5—5 of FIG. 4.

A second embodiment of the napkin retainer is shown in FIGS. 4 and 5. Similar parts shown in FIGS. 1, 2 and 3 are designated by similar numerals in FIGS. 4 and 5 with the addition a suffix "a".

Napkin retainer 10*a* comprises a tape portion 12*a* and a top protective cover 14*a*. The tape portion 12*a* and top cover 14 are rectangular and sized as previously described in connection with the embodiment shown in FIGS. 1, 2 and 3.

The difference between napkin retainer 10 and napkin retainer 10*a* is that the tape portion 12*a* is coated with adhesive 18*a* only on one side and has only one protective cover 14*a* for covering the adhesive. In all other regards the napkin retainer 10 of FIG. 1 and napkin retainer 10*a* of FIG. 4 are the same. The napkin retainer 10*a*, because it has one less protective cover, release coating and adhesive coating, is simpler and less expensive to manufacture.

In order to use napkin retainer 10*a*, the top cover 14*a* is peeled back to expose the adhesive 18*a*. The napkin retainer 10*a* is then applied to overlap the edge of the napkin and to engage the user's clothing.

Figure 6:
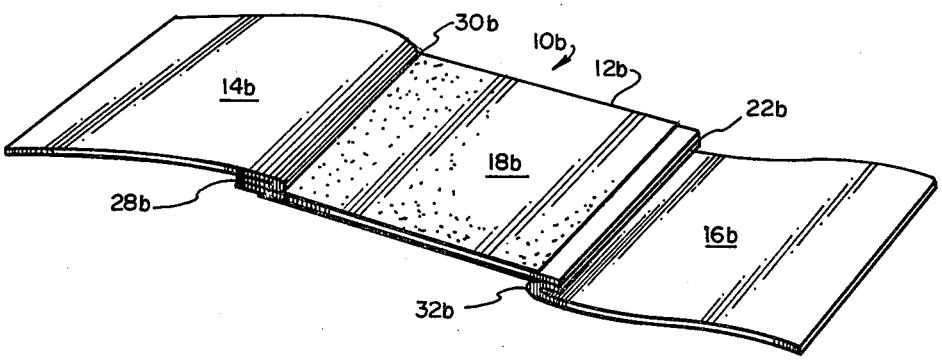
FIG. 6 is a perspective view of a third embodiment of the napkin retainer of the present invention showing the napkin retainer open just prior to use.
Figure 7:
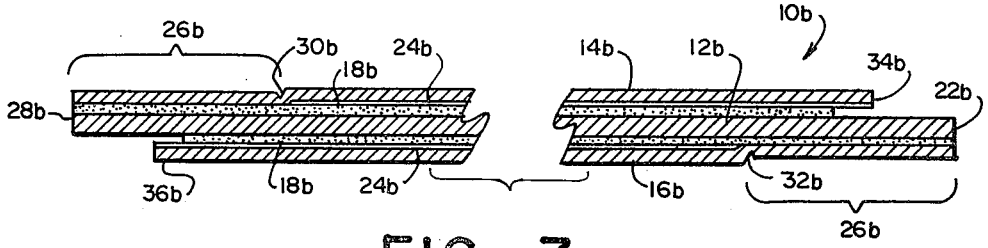
FIG. 7 is a longitudinal cross-sectional view of the napkin retainer of FIG. 6 showing the napkin retainer closed.

A third embodiment of the napkin retainer is shown in FIGS. 6 and 7. Again similar parts shown in FIGS. 1, 2 and 3 are designated by similar numerals in FIGS. 6 and 7 with the addition of a suffix "b".

The napkin retainer 10*b* is similar in size, shape and construction to napkin retainer 10 except that the bottom protective cover 16*b* has been reversed end for end so that the hinge 32*b* and hinge border 26*b* is adjacent end 22*b* of the tape portion 12*b* and the pick tab 36*b* is adjacent end 28*b* of the tape portion. In all other respects napkin retainer 10*b* is the same as napkin retainer 10 of FIG. 1.

The advantage realized from reversing protective cover 16*b* end for end is that it allows the user to open the napkin retainer 10*b* in a single operation. By grasping pick tabs 34*b* and 36*b* simultaneously and pulling simultaneously, the napkin retainer 10*b* is opened in a single step. The napkin retainer 10 of FIG. 1 requires each protective cover be peeled back individually.

Figure 8:
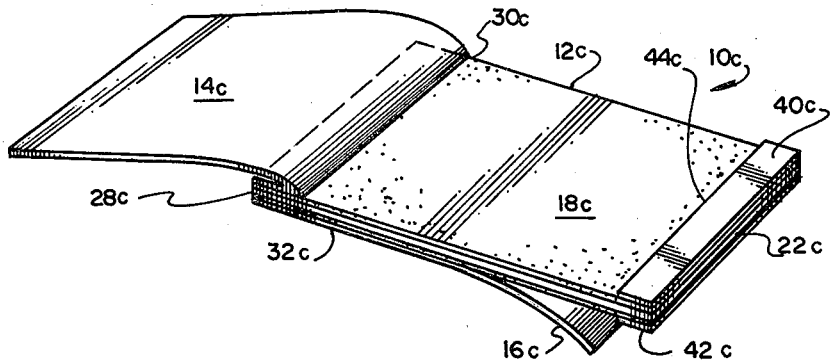
FIG. 8 is a perspective view of a fourth embodiment of the napkin retainer of the present invention shown partially open.
Figure 9:
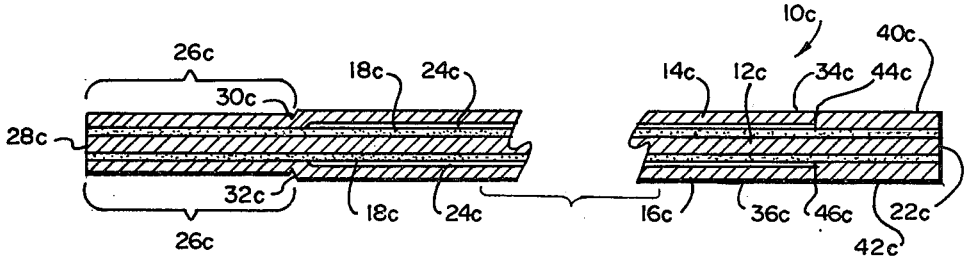
FIG. 9 is a longitudinal cross-sectional view of the napkin retainer of FIG. 8 showing the napkin retainer closed.

A fourth embodiment, and the preferred embodiment, of the napkin retainer is shown in FIGS. 8 and 9. Similar parts shown in FIGS. 1, 2 and 3 are designated by similar numerals in FIGS. 8 and 9 with the addition of a suffix "c".

The napkin retainer 10*c* is similar in size, shape and construction to napkin retainer 10 of FIG. 1. The difference between napkin retainer 10*c* and napkin retainer 10 of FIG. 1 resides in the construction of the pick tabs adjacent end 22*c*.

Referring to FIG. 9, the tape portion 12*c* has adhesive 18*c* over the entire area of both sides. There is no adhesive free border adjacent end 22*c* such as border 20 of napkin retainer 10, FIG. 1. Moreover, the protective covers 14*c* and 16*c* are the same length as the tape portion 12*c* instead of slightly shorter as those covers shown in FIG. 1.

The protective covers 14*c* and 16*c* has a release coating on the majority of one surface except for the hinge anchor border 26*c* adjacent end 28*c* of the tape portion and pick tab borders 40*c* and 42*c* respectively adjacent end 22*c* of the tape portion. The protective covers 14*c* and 16*c* are provided with lateral cut lines 44*c* and 46*c* at the boundaries of the pick tab borders 40*c* and 42*c*. The lateral cut lines 44*c* and 46*c* extend through the protective covers so that the pick tab borders 40*c* and 42*c* are severed from the rest of the protective covers 14*c* and 16*c*.

In order to open napkin retainer 10*c*, the user simply grasps the pick tab borders 40*c* and 42*c* in one hand and the protective covers 14*c* and 16*c* in the other hand and bends the napkin retainer 10*c* laterally, back and forth along the cut lines. As a result of the lateral bending action, cover ends 34*c* and 36*c* will be released from adhesive 18*c* and will curl away from the adhesive so that they may be grasped and peeled back.

The embodiment of FIGS. 8 and 9 is simpler to manufacture because the tape portion and the protective covers are the same size. Moreover, there are no loose ends on the protective covers which may unintentionally be snagged during handling resulting in the cover being unintentionally peeled off.

I claim as my invention:

1. A napkin retainer comprising a tape portion having adhesive coating on both sides and top and bottom protective covers each having adhesive release agent coated on one side, the tape portion being sandwiched between the top and bottom protective covers and juxtaposed with the adhesive release side of the top and bottom protective covers adjacent the adhesive of the tape portion, the top and bottom protective covers each having a hinge strip along one end without the adhesive release agent coated thereon and each protective cover having a nonserving score line located along a boundary between the adhesive release agent on each protective cover and the hinge strip so that the protective covers are permanently attached to the tape portion along a first end of the tape portion and will remain in their folded back position, and wherein the top and bottom protective covers are coextensive with the tape portion and each have a second end, remote from the hinge strip, that is cut laterally to provide pick tabs which will not be snagged during handling.

2. A napkin retainer comprising a tape portion having adhesive coated on both sides and top and bottom protective covers each having adhesive release agent coated on one side, the tape portion being sandwiched between the top and bottom protective covers and juxtaposed with the adhesive release side of the top and bottom protective covers adjacent the adhesive of the tape portion and wherein the top protective cover has a top hinge strip along one of its ends without the adhesive release agent coated thereon with a bottom protective cover nonsevering score line located along a boundary between the adhesive release agent on the bottom protective cover and its associated hinge strip so that the top protective cover is permanently attached to the tape portion along a first tape portion end and will remain in its folded back position and wherein the bottom protective cover has a bottom hinge strip along one of its ends without the adhesive release agent coated thereon with a top protective cover nonsevering score line located along a boundary between the adhesive release agent on the top protective cover and its associated hinge strip so that the bottom protective cover is permanently attached to the tape portion along a second tape portion end and will remain in its folded back position, and wherein the top and bottom protective covers are coextensive with the tape portion and are each cut laterally adjacent a second end, remote from the hinge strip to provide a pick tab which will not be snagged during handling.

* * * * *